United States Patent [19]

Facchina

[11] Patent Number: 4,778,090

[45] Date of Patent: Oct. 18, 1988

[54] SAND AND WIND BARRIER

[76] Inventor: Bernard G. Facchina, 10711 N. Lansdale St., Glenn Dale, Md. 20769

[21] Appl. No.: 9,522

[22] Filed: Feb. 2, 1987

[51] Int. Cl.[4] ..... A45F 4/02

[52] U.S. Cl. ..... 224/153; 383/4

[58] Field of Search ..... 224/151, 153, 209; 135/95; 383/4, 907

[56] References Cited

U.S. PATENT DOCUMENTS

| | | | |
|---|---|---|---|
| 41,418 | 2/1864 | Abbott | 224/151 |
| 2,554,688 | 5/1951 | Vollweiler | 135/95 |
| 3,625,533 | 9/1971 | Boe | 224/153 X |
| 4,236,657 | 12/1980 | Brunton | 224/153 |
| 4,423,834 | 1/1984 | Rush | 383/4 X |
| 4,471,794 | 9/1984 | Kirkham, Jr. | 135/95 |
| 4,587,682 | 5/1986 | Schultz | 224/153 X |
| 4,606,070 | 8/1986 | Schachter | 383/4 |
| 4,662,549 | 5/1987 | Dean | 224/209 X |

*Primary Examiner*—Henry J. Recla
*Assistant Examiner*—Robert Petrik
*Attorney, Agent, or Firm*—John B. Dickman, III

[57] ABSTRACT

A barrier device for shielding a user from windblown sand and dirt which is normally carried as a backpack and when unpacked and placed in an operative position acts as a protector for the user.

5 Claims, 1 Drawing Sheet

SAND AND WIND BARRIER

BACKGROUND OF THE INVENTION

All over the world, bathers, picknickers and sunbathers flock to sandy beaches, picnic areas and the like, to enjoy the benefits, mental and physical, of the outdoors. In many cases however, especially on windy days, the enjoyment of the outdoors is marred by sand and dust blowing into the eyes and on the clothes and bodies of the individuals. To attempt to protect themselves, said individuals have resorted to various means, including umbrellas, towels and the like, but these have not been satisfactory, and a better type of protection is needed.

The present invention overcomes these drawbacks by providing a portable, easily set up and taken down barrier for blocking wind, sand and dust.

It is, therefore, a primary object of this invention to provide an inexpensive, easily assembled and disassembled wind and sand barrier for use at beaches and other appropriate places.

It is a further object of this invention to provide a barrier device which is held in place by rods or stakes removably mounted in and in association with said barrier and inserted in the sand or dirt at the desired site.

A still further object is to provide a device of this type with conveniences such as a pocket or pockets for holding sun tan oil, cosmetics, sun glasses and the like.

A still further object is to provide such a device that can be rolled or folded up into a compact unit.

A further object is to provide a device as described that can be used as a blanket, bedroll, pillow and the like.

A still further object is to provide such a device that when turned inside out becomes a back pack or carrying bag.

Other objects will appear in the specification and claims.

DETAILED DESCRIPTION OF THE DRAWINGS

Figure 1:
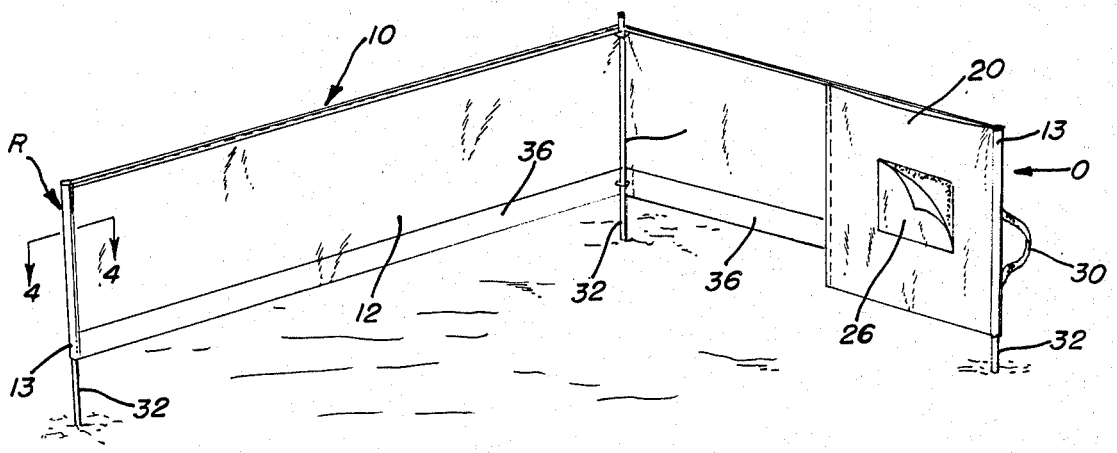
FIG. 1 is a perspective view of the barrier assembled and installed ready for use.
Figure 2:
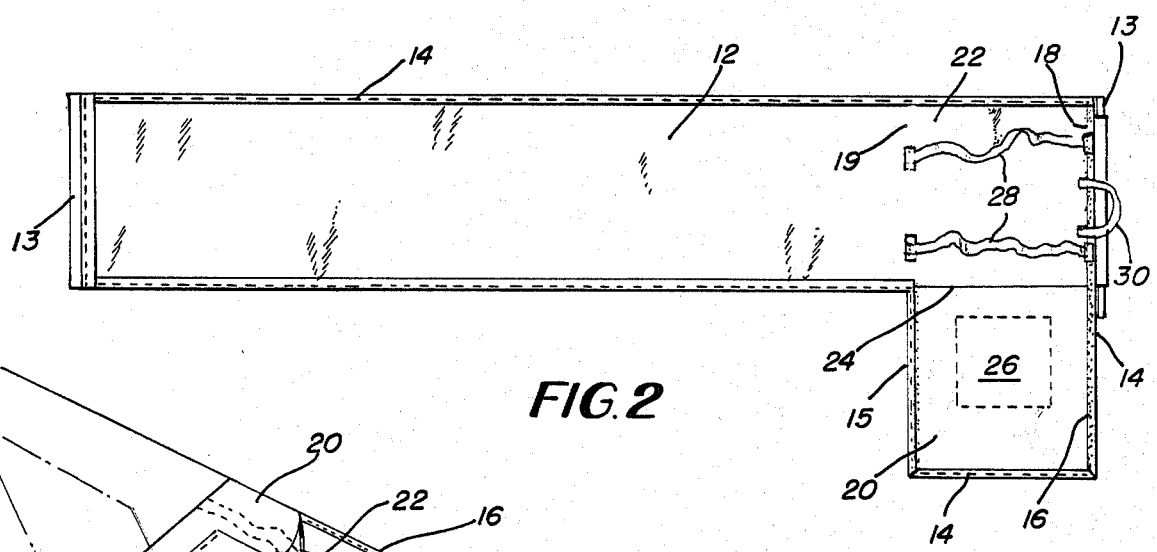
FIG. 2 is a top plan view of the barrier in its open unassembled position.
Figure 3:
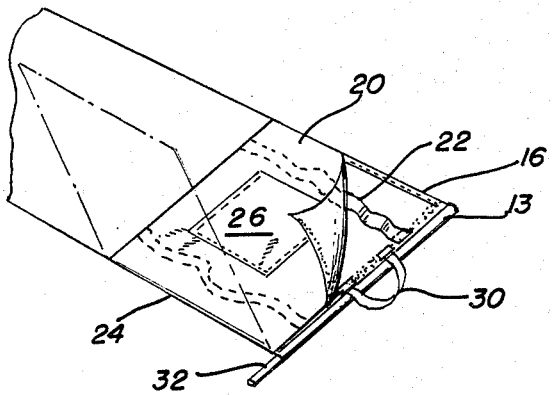
FIG. 3 is a perspective view of the pocket portion of the barrier showing the large pocket partially open.
Figure 4:
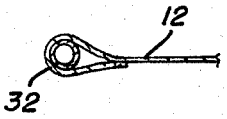
FIG. 4 is a sectional view taken on the line 4—4 of FIG. 1, showing the rod or stake holding means.
Figure 5:
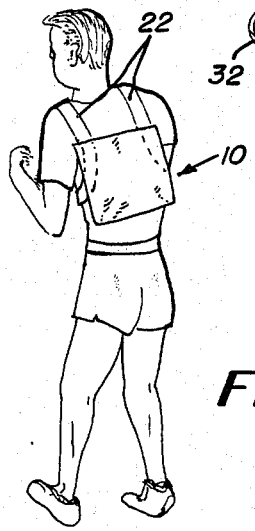
FIG. 5 is a perspective view of the barrier in its rolled up position, and carried as a "back pack".
Figure 6:
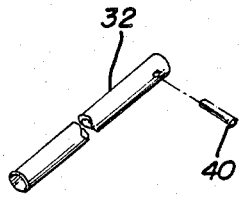
FIG. 6 is a perspective view of a stake used to secure the wind barrier.

Referring to the drawings in detail, the numeral 10 designates the device as a whole, said device comprising an L-shaped panel 12 of unitary construction, said panel having a reinforcing edge 14 made by folding the edge portion back upon itself and stitched, glued or otherwise fastened to form said edge. The lower flap 20 of the L-shaped portion of the device also has a "velcro" type of material along its edges, said material 16 being adapted to engage mating "velcro" material 18 disposed on the upper portion 22 of the L-shaped portion when folded along fold line 24. This will form a pocket for carrying and holding various articles used at the beach and other areas where such a device can be used. A second, smaller pocket 26 is formed on the lower flap 20 and can be used for holding smaller articles such as coins, gum, lipstick, and the like. This pocket also has "velcro" edges on its peripheral edges adapted to mate with corresponding "velcro" strips on the lower flap 20 to open and close the pocket as desired. Edge 15 is stitched to 22 along line 19.

Straps 28 are stitched or otherwise attached to the upper portion of the L-shaped portion 22, these can be used to hold the device in a rolled up position and as backpack straps when the large pocket is turned inside out. A handle 30 is attached to the edge of the upper flap to carry the device when in rolled up condition. Retaining members comprising pegs or stakes 32 are engaged with the panel 12 at various points and in various ways to hold the panel in any desired position, usually vertical, in relation to the ground. As shown in FIG. 1, turned over and stitched edge portions of the panel 12 form tubes 13 through which the rods or stakes 32 are inserted, with the ends of said stakes then being inserted in the sand or dirt. One or more intermediate stakes 32 are selectively positioned along the panel 12, as shown in FIG. 1, to keep the panel taut and give an angled shape to the panel for maximum wind deflection and protection.

If desired, a turned up flap or pocketed portion 36 may be formed on the lower edge portion of the panel 12, said portion 36 to be filled with sand at the site, which can then be redeposited at the site when the device is packed and rolled up for removal. This sand acts to hold the lower edge of the panel in close engagement with the sand on the beach and prevents wind and blowing said from coming underneath the panel and irritating the person or persons within the enclosure.

It is thought that the invention and many of its attendant advantages will be apparent from the foregoing description, and it will be apparent that various changes may be made in the form, construction and arrangement of parts without departing from the spirit or scope of the invention.

The stakes are hollow and of different diameters for telescoping together, each stake having an aperture therethrough for receiving a pin 40 for forcing the stakes into hard sand.

When the device is packed into a compact unit, the straps 28 are used to carry the device as a "back pack" or carrying bag.

I claim:

1. A convertible barrier device that is formed into a backpack when not in use for blocking wind, windblown sand and dirt, comprising a first elongate panel of flexible material having top, bottom and side edges and having a right angled portion defining a second panel extending laterally from a side edge at one end in the same plane as the first elongate panel forming an L-shaped structure when the barrier is in a disassembled position, a plurality of retaining member removeably engaged with said elongate panel to hold said elongate panel in an upright position when used for blocking wind, said side edge of said elongate panel from which said right angled portion extends defining an intermediate fold line, the peripheral edges of said first and second panels having mating fastening means thereon, whereby when said second panel is folded upon said elongate panel along said fold line said peripheral edges of said first and second panels will be removably attached by said fastening means to form a pocket therebetween, into which the remaining portions of said first panel is stored when formed as a backpack, and strap means on said first panel for carrying said panels when formed as a backpack.

2. A device as set forth in claim 1, in which said elongate panel has a pocket portion formed on its bottom edge when upright for receiving sand, dirt and other weighting material.

3. A device as set forth in claim 1, in which said second panel has at least one small pocket formed thereon.

4. A device as set forth in claim 3, in which said at least one strap means is a plurality of elongated straps attached at their ends to the inside of said pocket member and forming loops between said attached ends, said straps adapted to be pulled out of said pocket and placed around the shoulders of a user to hold the device in a back pack carrying condition when desired.

5. A device as set forth in claim 1 whereby when the pocket is turned inside out with the panel enclosed therein, said pocket is transformed into a carrying case and back pack.

* * * * *